US012385189B2

(12) United States Patent
Rieger

(10) Patent No.: US 12,385,189 B2
(45) Date of Patent: Aug. 12, 2025

(54) CONNECTION DEVICE AND SYSTEM FOR SUSPENDING A MONORAIL BEAM FROM A ROOF BOLT

(71) Applicant: SANDVIK MINING AND CONSTRUCTION G.M.B.H., Zeltweg (AT)

(72) Inventor: Hubert Rieger, Mobersdorf-Siedlung (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 803 days.

(21) Appl. No.: 17/641,237

(22) PCT Filed: Sep. 9, 2019

(86) PCT No.: PCT/EP2019/073927

§ 371 (c)(1),
(2) Date: Mar. 8, 2022

(87) PCT Pub. No.: WO2021/047748

PCT Pub. Date: Mar. 18, 2021

(65) Prior Publication Data

US 2022/0325626 A1 Oct. 13, 2022

(51) Int. Cl.
*E01B 25/24* (2006.01)
*E01B 23/04* (2006.01)
(Continued)

(52) U.S. Cl.
CPC ..... *E01B 25/24* (2013.01); *E01B 23/04* (2013.01); *E21D 21/0093* (2013.01); *E21F 17/02* (2013.01)

(58) Field of Classification Search
CPC ..... E21F 17/02; E21F 17/00; E01B 23/04; E01B 23/02; E01B 25/24; E21D 21/0093
See application file for complete search history.

(56) References Cited

U.S. PATENT DOCUMENTS 340,055 A * 4/1886 Myers ..... E01B 25/24 104/107
2,156,827 A * 5/1939 Wehr ..... E01B 25/24 191/40

(Continued)

FOREIGN PATENT DOCUMENTS

CN 107956497 A 4/2018
CN 207248634 U 4/2018

(Continued)

*Primary Examiner* — S. Joseph Morano
*Assistant Examiner* — Cheng Lin
(74) *Attorney, Agent, or Firm* — Corinne R. Gorski

(57) ABSTRACT

A connection device for suspending a monorail beam includes a top anchor integrated with or attachable to a roof bolt and a clamping device for connection to the monorail beam. The clamping device has a housing attachable to the monorail beam. The housing includes a central recess with an opening configured such that the top anchor is movable into and out of the central recess along a first axis through the opening. The clamping device has a plurality of locking members radially movable into and out of the central recess with respect to the first axis between an inner locking position in which the locking members prevent the top anchor from moving out of the central recess, and an outer open position in which the top anchor is free to move past the locking members, each respective locking member being provided in a respective radial guide recess of the housing.

17 Claims, 5 Drawing Sheets

(51) Int. Cl.
*E21D 21/00* (2006.01)
*E21F 17/02* (2006.01)

(56) References Cited

U.S. PATENT DOCUMENTS 3,219,199 A * 11/1965 Lagerstrom ..... E21D 9/12 104/111
3,990,665 A * 11/1976 Joussemet ..... A47B 43/006 52/39
4,116,134 A * 9/1978 Troth ..... E01B 25/24 104/111
4,255,070 A * 3/1981 Calhoun ..... E21F 17/02 104/111
4,286,523 A 9/1981 Densmore
4,300,859 A * 11/1981 Donan, Jr. ..... E21D 21/0093 277/648
4,306,696 A * 12/1981 Pondman ..... F16L 3/16 248/62
4,472,088 A * 9/1984 Martin ..... E21D 21/0026 52/704
5,147,151 A * 9/1992 Hipkins, Jr. ..... E21D 21/0093 411/338
5,474,274 A 12/1995 Bernosky
6,991,547 B2 * 1/2006 Dever ..... E21D 20/025 470/11
2002/0064429 A1 * 5/2002 Robertson, Jr. ..... E21D 21/008 405/259.1

FOREIGN PATENT DOCUMENTS

| | | | |
|---|---|---|---|
| CN | 109881689 | A | 6/2019 |
| DE | 19633220 | C2 | 5/2002 |
| EP | 1770047 | A1 | 4/2007 |
| GB | 2174049 | A | 10/1986 |
| RU | 2009111767 | A | 10/2010 |
| RU | 106624 | U1 | 7/2011 |
| RU | 120932 | U1 | 10/2012 |
| WO | 2012072095 | A1 | 6/2012 |

* cited by examiner

CONNECTION DEVICE AND SYSTEM FOR SUSPENDING A MONORAIL BEAM FROM A ROOF BOLT

RELATED APPLICATION DATA

This application is a § 371 National Stage Application of PCT International Application No. PCT/EP2019/073927 filed Sep. 9, 2019.

TECHNICAL FIELD

The present invention relates to roof-hung monorail systems for material transport, person transport or equipment transport, for example in underground tunnels of mines. Specifically, the present disclosure relates to suspension and installation of such monorail systems.

BACKGROUND

Roof-hung monorail systems are used in underground tunnels of mines for transport a load through the tunnel using vehicles adapted to be suspended on the monorail for travelling along the monorail.

Monorails may be suspended using roof bolts attached to a roof of a mine. A roof bolt is commonly provided with a central rod provided with an outer threaded portion to which a nut is attachable.

The monorail comprises a plurality of monorail beams which are attached end-to-end to form a continuous monorail track. The alignment between individual beams is thus important and the suspension must allow for correct alignment of the individual beams. Beams may be straight or curved depending on the desired extension of the monorail throughout the tunnel.

Different systems exist for connection of monorail beams to a roof.

A first example of a known connection system is the use of hooks welded to the beams. Each hook is suspended from a roof bolt using a shackle attached to the threaded rod of the roof bolt using a nut. At installation of such a system, shackles are first manually attached to each roof bolt where after an individual beam is lifted close to its final position and hooked into each corresponding shackle. The system is cumbersome to install and requires precise relative positioning between roof bolts and hooks in order to provide the required alignment accuracy.

A second example of a known connection system is shown in U.S. Pat. No. 4,286,523 in which an I-beam is attached to a roof bolt using a washer-like element holding a horizontal bolt which in turn presses two clamping brackets (called keeper members) on opposing sides of the beam against the beam to thereby hold it attached to the washer-like element and thus to the roof bolt. The system is complex with many parts that needs to be correctly assembled and tensioned.

A third example of a known connection system is shown in U.S. Pat. No. 4,116,134 in which an I-beam is attached to a roof bolt using clamping brackets and bolts. The system is complex with many parts that need to be correctly assembled and tensioned.

A fourth example of a known connection system is shown in US patent EP 1 770 047 A1 in which a lower profile is attached to an upper profile using a swivel device comprising clamping brackets and bolts. The system is complex with many parts that need to be correctly assembled and tensioned.

A fifth example of a known connection system is shown in UK patent application GB 2 174 049 A in which a bracket is pivotally suspending two adjacent beams. The system is complex with many parts to assemble at installation.

Hence, there is a need for an improved suspension system enabling easier installation of monorail beams, whilst providing a robust suspension and correct alignment of beams.

SUMMARY

An object of the invention is to enable easier installation of monorail beams to roof bolts. According to a first aspect of the invention, this object is achieved by an inventive connection device for suspending a monorail beam in a mine roof. The connection device comprises a top anchor integrated with a roof bolt or attachable to a roof bolt. Further, the connection device comprises a clamping device for connection to the monorail beam. The clamping device comprises a housing attachable to the monorail beam, wherein the housing comprises a central recess provided with an opening configured such that the top anchor is movable into and out of the central recess along a first axis through the opening. The clamping device comprises a plurality of locking members radially movable into and out of the central recess with respect to the first axis between an inner locking position in which the locking members prevent the top anchor from moving out of the central recess, and an outer open position in which the top anchor is free to move past the locking members. Also, each respective locking member is provided in a respective radial guide recess of the housing.

The top anchor can be an integrated part of a central rod of the roof bolt or the top anchor can be a nut or other member attachable to the central rod of the roof bolt, or the top anchor can be another body otherwise attached to the central rod of the roof bolt, such as by mechanical interlocking or by plastic deformation of the top anchor for clamping it to the central rod of the roof bolt. The clamping device is attached to a monorail beam by any suitable means such as by welding or bolting.

Upon installation of the monorail beam to the roof bolt, the monorail beam is moved such that the top anchor moves into the central recess of the housing. Once enough inserted into the central recess, the locking members are moved radially inwards until they prevent movement of the top anchor out of the central recess of the housing, thereby locking the clamping device to the bolt, wherein the monorail beam is attached to the bolt. The radial guide recesses allow each respective locking member to move radially in and out of the housing whilst preventing the locking members from moving along the first axis upon force being applied to locking members by the top anchor.

The connection device may further comprise a biasing means configured to bias the locking members towards their locking position. The biasing means biasing the locking members towards their locking position enables automatic movement of the locking members to their locking position, thereby simplifying connection of the monorail beam to the roof bolt.

The biasing means may comprise a resilient ring or clip provided around the housing for biasing a radially outer portion of each respective locking member.

The connection device may further comprise a securing member movably fitted around the housing for movement between a secured position in which the securing member prevents the locking members from being moved from their locking position radially outwards to their open position, and an unsecuring position in which the locking members are free to move from their locking position to their outer open position.

In its securing position, the securing member thus prevents the locking members from moving to their open position, thereby preventing inadvertent disconnection of the top anchor from the clamping device. Upon mounting of a monorail beam to the roof bolt, the clamping device is first attached to the top anchor, then the securing member is moved to its securing position such that the locking members cannot release the top anchor.

The securing member is a ring fitted around the housing such that the ring is slidable back and forth along the first axis between the securing position and the unsecuring position.

The connection device may be configured such that, when in use for attaching the monorail beam to the roof bolt above the monorail beam, the unsecuring position is above the securing position. The securing member is thus vertically movable from the unsecuring position to the securing position by the force of gravity. Hence, the securing member cannot be inadvertently moved to its unsecuring position by the force of gravity. Also, after connection of the monorail beam to the roof bolt, the securing member falls down by the force of gravity to the securing position, thereby promoting easy and secure installation.

The locking members may be provided with chamfered lead-in portions configured such that the top anchor is able to force the locking members radially outwards towards their open position at insertion of the top anchor into the central recess of the housing. The chamfered lead-in portions enable automatic movement of the locking members radially outwards at connection of the clamping device to the top anchor thereby mitigating any need of manual actions to move the locking members radially outwards, hence simplifying connection of the monorail beam to the roof bolt.

The top anchor may be provided with a tapered lead-in portion which may be may be conical. When the locking members are in their radially inner position, the locking position, there must be a radial space between the locking members to allow for the top anchor to push the locking members apart. The tapered lead-in portion provides for a smaller size of the outer end of the top anchor, thereby reducing the size for the opening between the locking members required for enabling them to be forced apart by insertion of the top anchor. Hence, the tapered lead-in portion enables automatic movement of the locking members radially outwards at connection of the clamping device to the top anchor thereby mitigating any need of manual actions to move the locking members radially outwards, hence simplifying connection of the monorail beam to the roof bolt.

The connection device may further comprise an elongate anchor profile for attachment to the monorail beam, wherein the housing is provided with a lower coupling means adapted engage the anchor profile such that the lower coupling means is slidable along at least a portion of the length of the anchor profile for attachment of the housing to the anchor profile. The sliding engagement of the lower coupling means to the anchor profile enables compensation of offset tolerances when attaching the monorail beam to roof bolts.

The anchor profile comprises an interior space and an elongate opening into the interior space along at least a portion of the length of the anchor profile, wherein the lower coupling means is configured to be movable through an end opening of the hollow profile into the interior space of the hollow profile with a stem of the lower coupling means extending through the elongate opening. Also, the anchor profile may be a square profile.

The elongate opening may extend throughout the full length of the anchor profile. The anchor portion of the clamping device can thus be slid into and out of the anchor profile from either end of the anchor profile, thereby simplifying connection and disconnection of a clamping device to a monorail beam provided with the anchor profile.

The connection device may further comprise a release tool comprising a plurality of segments configured to fit together such that they jointly form a sleeve around the central rod, said sleeve being movable along the central rod into the central recess and configured for forcing the locking members radially outwards to their respective outer open position at said movement into the central recess.

The top anchor may comprise a nut comprising a central threaded recess for connection to a corresponding threaded portion of a central rod of a roof bolt. The central recess may be annular. Also, the top anchor may be axisymmetric.

According to a second aspect of the invention, the objective is also achieved by a monorail system comprising a monorail beam and a connection device as described above. The clamping device of the system may be attached to the monorail beam.

BRIEF DESCRIPTION OF DRAWINGS

FIG. 1 shows a perspective view of the connection device with the locking members in an inner locking position.

FIG. 2 shows a perspective view of the connection device with the locking members is an outer open position.

FIG. 3 shows a system comprising the connection device before connection to a roof bolt.

FIG. 4 shows the system also shown in FIG. 3 after connection to the roof bolt.

FIG. 5 shows a side view of the connection device also shown in FIG. 1 and marks the positions of sectional views A, B and C.

FIG. 6 shows a top view in cross section B-B of the connection device also shown in FIG. 5.

FIG. 7 shows a side view in cross section A-A of the connection device also shown in FIG. 5.

FIG. 8 shows a side view in cross section C-C of the connection device of FIG. 5, however with its locking members moved to their outer open positions.

| | |
|---|---|
| 1 | connection device |
| 2 | top anchor |
| 3 | central rod |
| 4 | clamping device |
| 5 | housing |
| 6 | central recess |
| 7 | first axis |
| 8 | locking member |
| 9 | inner locking position |
| 10 | outer open position |
| 11 | guide recess |
| 12 | biasing means |
| 13 | securing member |
| 14 | securing position |
| 15 | unsecuring position |
| 16 | chamfered lead-in portion (of locking members) |
| 17 | tapered lead-in portion (of top anchor) |
| 18 | anchor profile |

-continued

| | |
|---|---|
| 19 | lower coupling means |
| 20 | release tool |
| 21 | monorail beam |

DETAILED DESCRIPTION

A connection device 1 according to a first embodiment will hereinafter be described with reference to the appended drawings.

Figure 1:
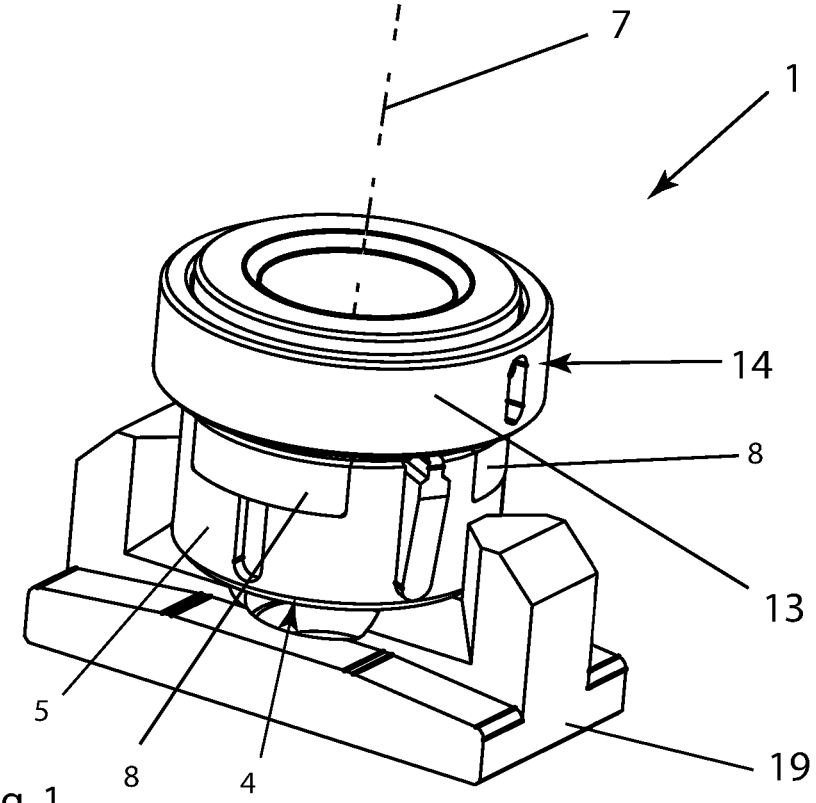
FIGS. 1-8 all show a first embodiment of a connection device for suspending a monorail beam.
Figure 2:
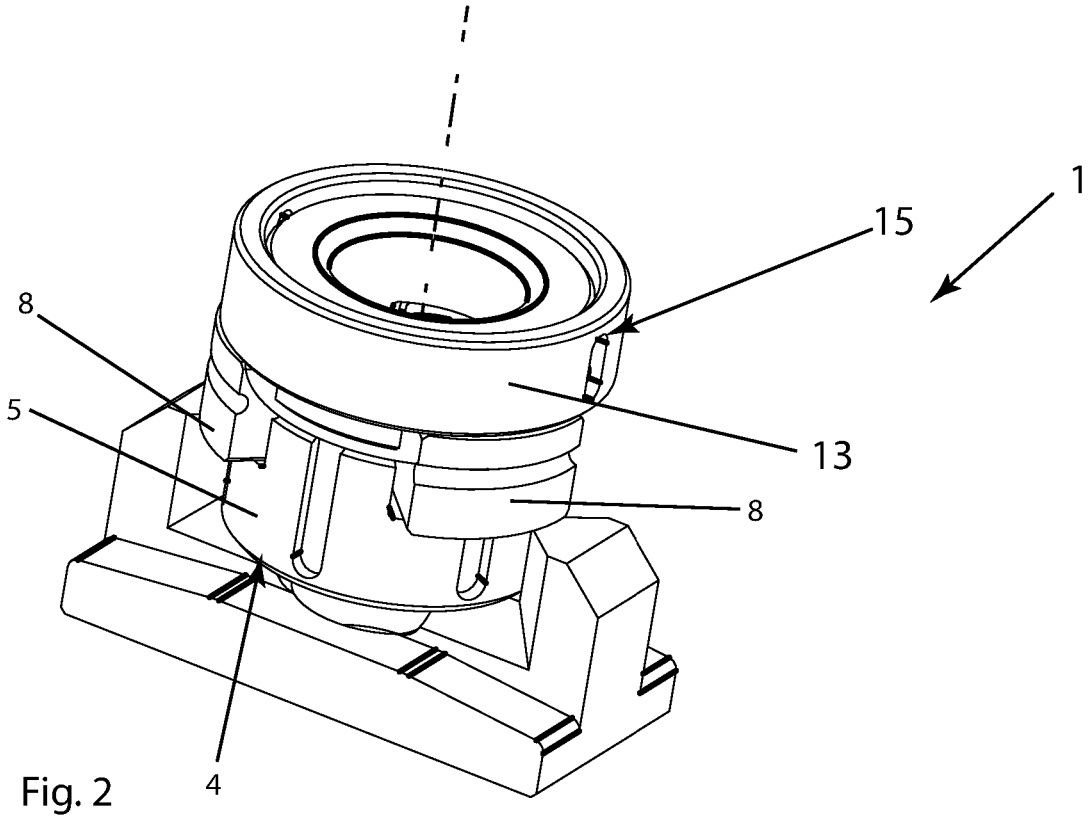
Figure 3:
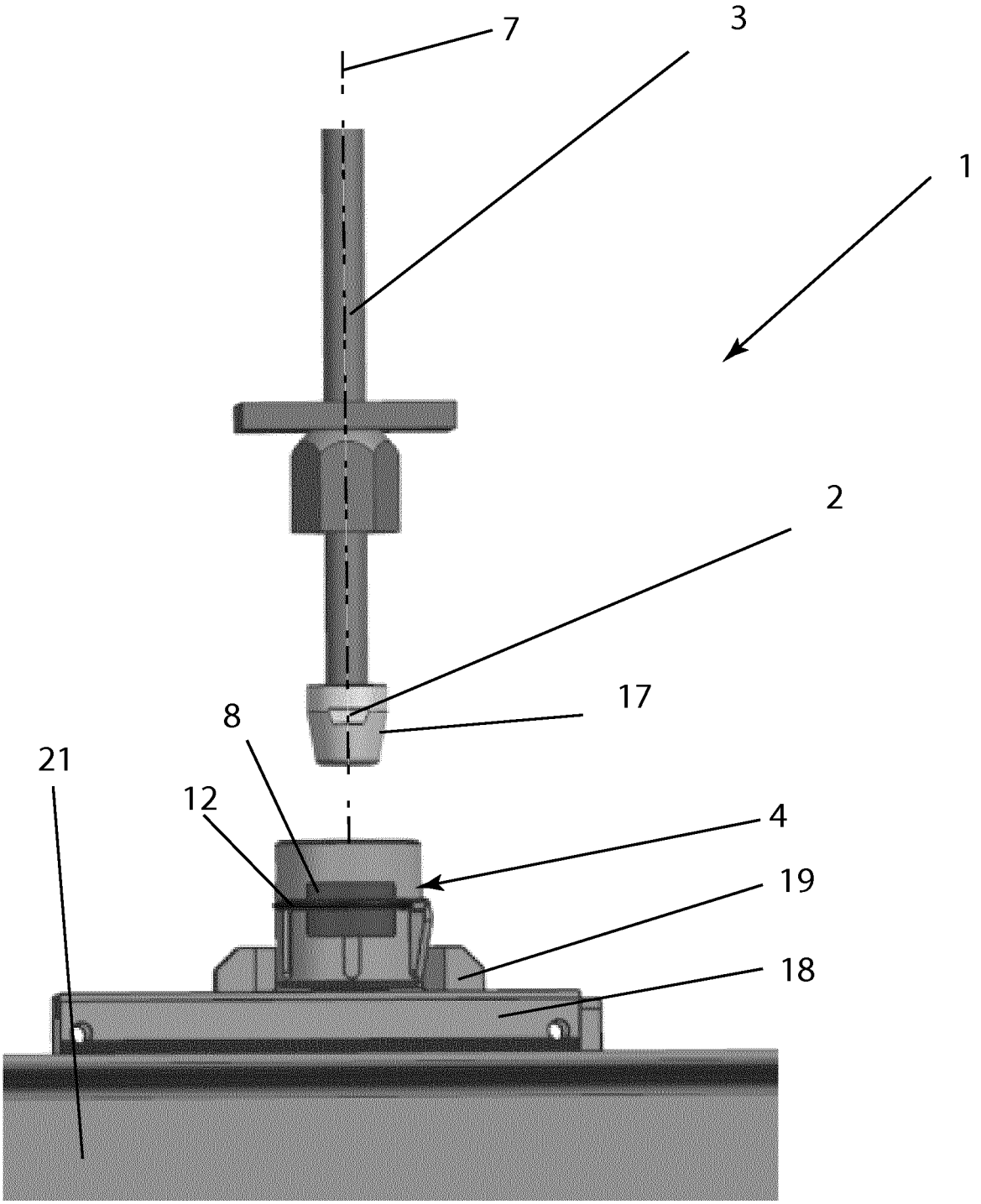
Figure 4:
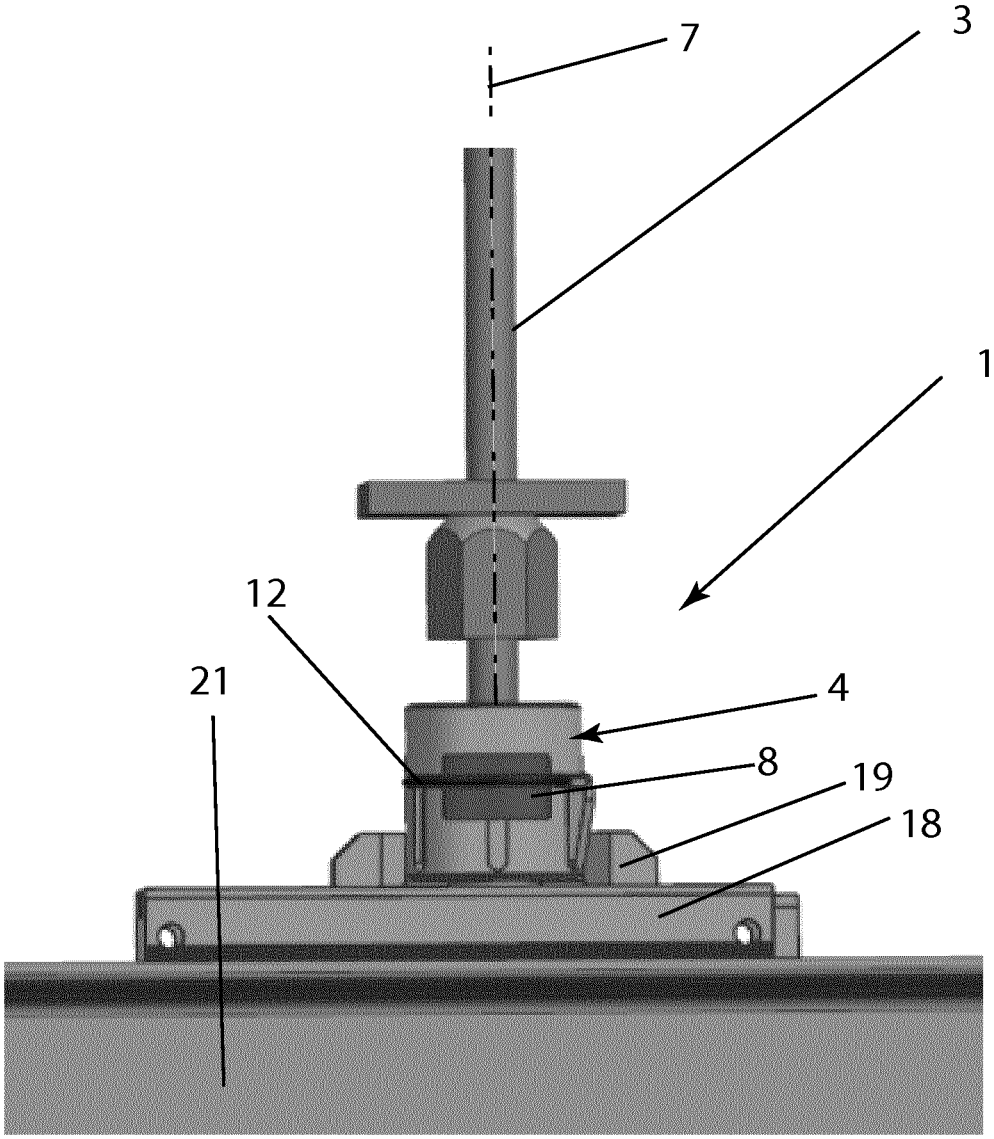
Figure 5:
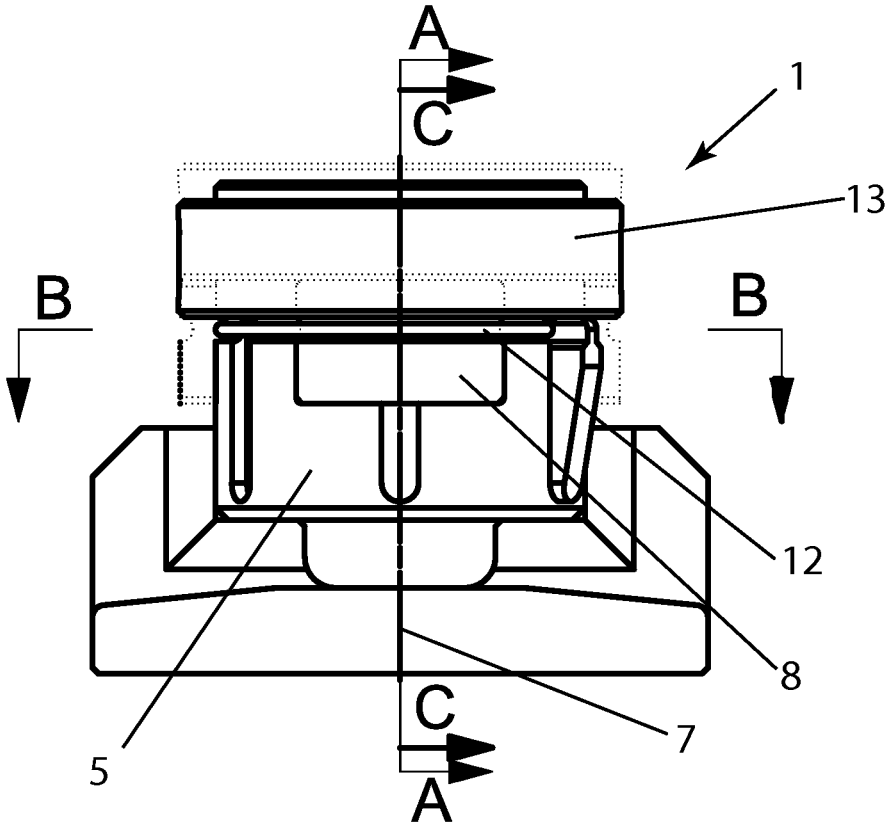
Figure 6:
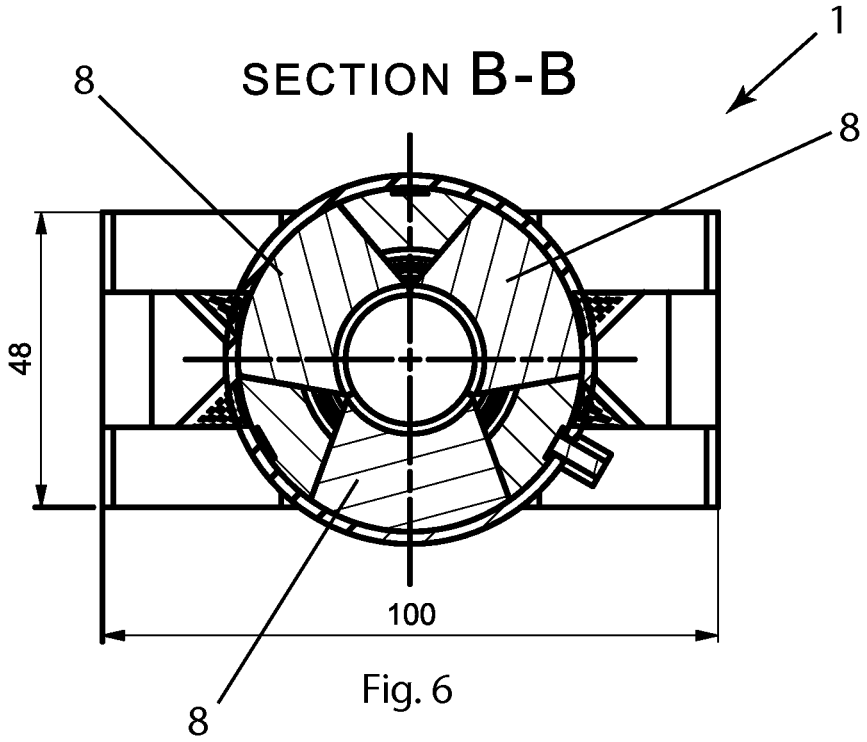

As shown in FIGS. 3-4, the connection device 1 is for suspending a monorail beam 21. The connection device 1 comprises a top anchor 2 integrated with a roof bolt or attachable to a roof bolt. Also, the connection device 1 comprises a clamping device 4 for connection to the monorail beam 21, wherein the clamping device 4 comprises a housing 5 attachable to the monorail beam 21.

The housing 5 comprises a central recess 6 provided with an opening configured such that the top anchor 2 is movable into and out of the central recess 6 along a first axis 7 through the opening. The first axis 7 may be a vertical axis but may alternatively have some other orientation.

The clamping device 4 comprises three locking members 8 radially movable into and out of the central recess 6 with respect to the first axis 7, which is typically vertical, between an inner locking position 9 in which the locking members 8 prevent the top anchor 2 from moving out of the central recess 6, and an outer open position 10 in which the top anchor 2 is free to move past the locking members 8. Also, each respective locking member 8 is provided in a respective radial guide recess 11 of the housing 5.

The top anchor 2 is a nut but could in other embodiments alternatively be an integrated part of the central rod 3 of the roof bolt or the top anchor 2 could be some other suitably shaped member attachable to the central rod 3 of the roof bolt such as by mechanical interlocking or by plastic deformation of the top anchor for clamping it to the central rod 3 of the roof bolt. The clamping device 4 is attached to a monorail beam 21 by welding but in other embodiment any suitable means of attachment could be used such as bolting. Also, although three locking members are provided according to the first embodiment, two, four or more locking members could alternatively be provided in other embodiments.

The connection device 1 comprises a biasing means 12 configured to bias the locking members 8 towards their locking position. The biasing means 12 comprises a resilient ring or clip provided around the housing 5 for biasing a radially outer portion of each respective locking member 8 radially inwards towards the locking position.

The biasing of the locking members 8 towards their locking position enables automatic movement of the locking members to their locking position, thereby simplifying connection of the monorail beam 21 to the roof bolt.

The connection device 1 further comprises a securing member 13 movably fitted around the housing 5 for movement between a secured position 14 in which the securing member 13 prevents the locking members 8 from being moved from their locking position 9 radially outwards to their open position 10, and an unsecuring position 15 in which the locking members 8 are free to move from their locking position 9 to their outer open position 10. In other embodiments, the securing member 13 could alternatively be omitted.

In its securing position 14, the securing member 13 thus prevents the locking members 8 from moving to their open position 10, thereby preventing inadvertent disconnection of the top anchor 2 from the clamping device 4. Upon mounting of a monorail beam 21 to the roof bolt, the clamping device 4 is first attached to the top anchor 2, then the securing member 13 is moved to its securing position such that the locking members 8 cannot release the top anchor 2.

In this embodiment, the securing member 13 is a ring fitted around the housing 5 such that the ring is slidable back and forth along the first axis 7 between the securing position 14 and the unsecuring position 15. However, in other embodiments, the securing member 13 could alternatively have some other suitable shape such as a plurality of individual members 8 movably attached to the housing 5.

The connection device 1 is configured such that, when in use for attaching the monorail beam 21 to the roof bolt above the monorail beam 21, the unsecuring position 15 is above the securing position 14, such as straight vertically above.

The securing member 13 is thus vertically movable from the unsecuring position 15 to the securing position 14 by the force of gravity, thereby promoting easy and secure installation. Hence, the securing member 13 cannot be inadvertently moved to its unsecuring position 15 by the force of gravity.

Figure 7:
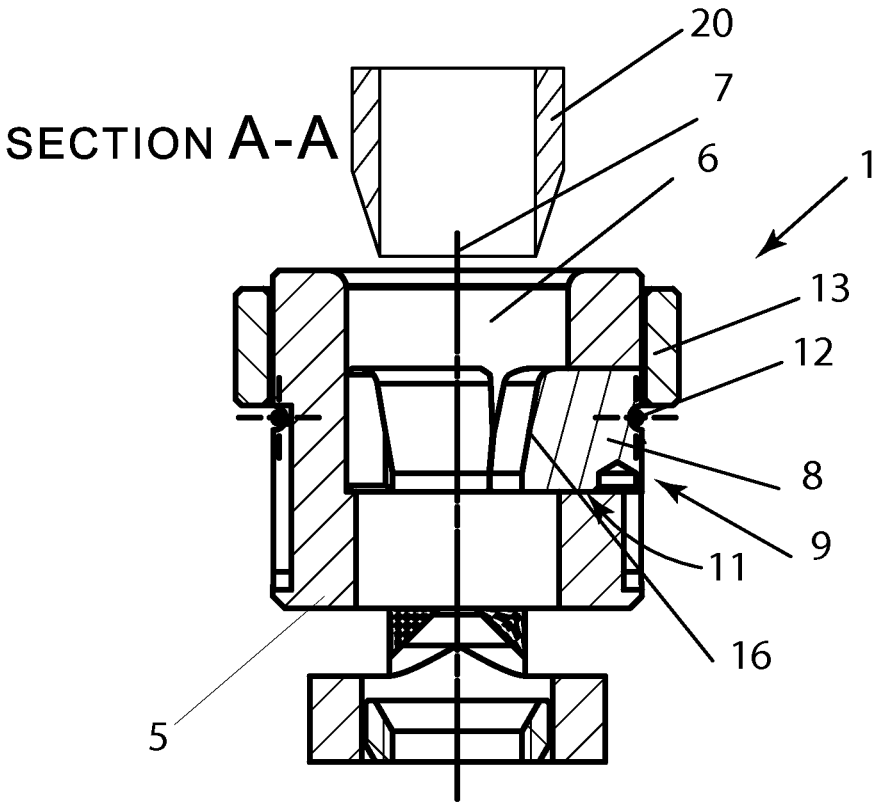
Figure 8:
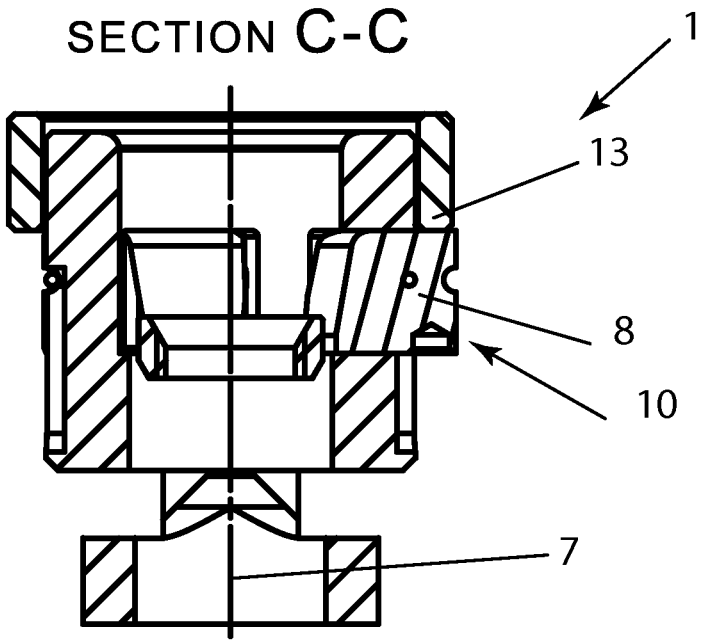

As shown in FIG. 7, the locking members 8 are provided with chamfered lead-in portions 16 configured such that the top anchor 2 is able to force the locking members radially outwards towards their open position at insertion of the top anchor 2 into the central recess 6 of the housing 5. In other embodiments, the chamfered lead-in portions may be omitted. For example, the connection device 1 may be configured such that the locking members 8 when in their inner locking position define a central space into which a portion of the top anchor is movable to thereby force the locking members radially outwards upon attachment of the connection device 1 to the roof bolt.

The chamfered lead-in portions enable automatic movement of the locking members radially outwards at connection of the clamping device to the top anchor 2 thereby mitigating any need of manual actions or separate mechanisms for moving the locking members 8 radially outwards, hence simplifying connection of the monorail beam 21 to the roof bolt.

The top anchor 2 is provided with a tapered lead-in portion 17, wherein the tapered lead-in portion is conical. In other embodiments, the tapered lead-in portion may alternatively be omitted or have some other shape than conical.

When the locking members 8 are in their radially inner position, the locking position, there must be a radial space between the locking members 8 to allow for the top anchor 2 to push the locking members 8 apart. The tapered lead-in portion provides for a smaller size of the outer end of the top anchor 2, thereby reducing the size for the opening between the locking members 8 required for enabling them to be forced apart by insertion of the top anchor 2. Hence, the tapered lead-in portion enables automatic movement of the locking members 8 radially outwards at connection of the clamping device 4 to the top anchor 2 thereby mitigating any need of manual actions to move the locking members 8 radially outwards, hence simplifying connection of the monorail beam 21 to the roof bolt.

The connection device 1 further comprises an elongate anchor profile 18 for attachment to the monorail beam 21, wherein the housing 5 is provided with a lower coupling means 19 adapted engage the anchor profile 18 such that the lower coupling means 19 is slidable along at least a portion of the length of the anchor profile 18 for attachment of the housing 5 to the anchor profile 18. The sliding engagement of the lower coupling means 19 to the anchor profile 18 enables compensation of offset tolerances when attaching the monorail beam 21 to roof bolts.

The anchor profile 18 comprises an interior space and an elongate opening into the interior space along at least a portion of the length of the anchor profile 18. The lower coupling means 19 is configured to be movable through an end opening of the hollow profile into the interior space of the hollow profile with a stem of the lower coupling means extending through the elongate opening. In this embodiment, the anchor profile 18 is a square profile but in other embodiments the anchor profile could have any other suitable shape/profile.

Also, the housing 5 may in other embodiments alternatively be directly attached to the monorail beam 21 instead of via the anchor profile 18 and the lower coupling means 19 such that the anchor profile and the lower coupling means may be omitted. For example, the housing 5 could be attached to the monorail beam 21 by being welded or by being attached to the beam 21 by a bolt.

When the monorail beam 21 is to be installed, the top anchor 2 is first provided on each roof bolt. In the first embodiment the top anchor 2 is a nut comprising a central threaded recess. The top anchor 2 may thus be easily screwed onto the outer threaded portion of the central rod 3 of the roof bolt. Once the top anchor 2 is provided on the roof bolt, the monorail beam 21 is moved such that the top anchor 2 moves into the central recess 6 of the housing 5. Once enough inserted into the central recess 6, the locking members 8 are moved radially inwards by the force of the biasing means 12 until the locking members 8 prevent movement of the top anchor 2 out of the central recess 6 of the housing 5, thereby locking the clamping device 1 to the roof bolt such that the monorail beam 21 is attached to the roof bolt. The radial guide recesses allow each respective locking member 8 to move radially in and out of the housing 5 whilst preventing the locking members 8 from moving vertically along the first axis upon force being applied to the locking members by the top anchor 2.

When the monorail beam 21 is to be disconnected from the roof bolt, the locking members 8 are moved radially outwards to their outer open positions such that the top anchor 2 is once again free to move out of the central recess 6.

In order to facilitate disconnection, a release tool 20 may be provided, either integrated with the connection device 1 as shown in FIG. 7 or in the form of a separate tool movable between a plurality of connection devices 1 for repeated use.

The release tool 20 shown in FIG. 7 is cylindrical with a tapered outer front portion configured to be able to force the locking members radially outwards upon the release tool 20 being forced into the central recess 6. The inner diameter of the release tool 20 is sized large enough to allow the top anchor 2 to move through the release tool 20 at disconnection of the top anchor 2. Hence, the cylindrical configuration of the release tool 20 allows it to be locked in place around the central rod of the roof bolt after installation of a monorail beam 21, such that the release tool 20 is always present for subsequent disconnection of the monorail beam 21, which is very convenient. In other embodiments, the release tool 20 could alternatively be divided in a plurality of parts together forming a release tool 20 able to move the locking members 8 radially outwards similar to the cylindrical release tool 20. The separate parts can thus be fitted around the central rod of any roof bolt thereby mitigating any need of providing one release tool 20 per connection device 1.

The invention claimed is:

1. A connection device for suspending a monorail beam in a mine roof, the connection device comprising:

a top anchor integrated with a roof bolt or attachable to a roof bolt; and a clamping device for connection to the monorail beam, the clamping device including a housing attachable to the monorail beam, wherein the housing includes a central recess provided with an opening configured such that the top anchor is movable into and out of the central recess along a first axis through the opening, wherein the clamping device includes at least one locking member radially movable into and out of the central recess with respect to the first axis between an inner locking position in which the at least one locking member prevents the top anchor from moving out of the central recess, and an outer open position in which the top anchor is free to move past the at least one locking member, and wherein each at least one locking member is provided in a respective radial guide recess of the housing.

2. The connection device according to claim 1, further comprising a biasing means configured to bias the at least one locking member towards the inner locking position.

3. The connection device according to claim 2, wherein the biasing means includes a resilient ring or clip provided around the housing for biasing a radially outer portion of each at least one locking member.

4. The connection device according to claim 1, further comprising a securing member movably fitted around the housing for movement between a secured position in which the securing member prevents the at least one locking member from being moved from the inner locking position radially outwards to the outer open position, and an unsecuring position in which the least one locking member is free to move from the inner locking position to the outer open position.

5. The connection device according to claim 4, wherein the securing member is a ring fitted around the housing such that the ring is slidable back and forth along the first axis between the securing position and the unsecuring position.

6. The connection device according to claim 5, configured such that, when in use for attaching the monorail beam to the roof bolt above the monorail beam, the unsecuring position is above the securing position.

7. The connection device according to claim 1, wherein the at least one locking member is provided with chamfered lead-in portions configured such that the top anchor is able to force the locking members radially outwards towards their open position at insertion of the top anchor into the central recess of the housing.

8. The connection device according to claim 1, wherein the top anchor is provided with a tapered lead-in portion.

9. The connection device according to claim 8, wherein the tapered lead-in portion is conical.

10. The connection device according to claim 1, further comprising an elongate anchor profile arranged for attachment to the monorail beam, wherein the housing is provided with a lower coupling means arranged to engage the anchor profile such that the lower coupling means is slidable along at least a portion of a length of the anchor profile for attachment of the housing to the anchor profile.

11. The connection device according to claim 10, wherein the anchor profile includes an interior space and an elongate opening into the interior space along at least a portion of the length of the anchor profile, wherein the lower coupling means is configured to be movable through an end opening of the hollow profile into the interior space of the hollow profile with a stem of the lower coupling means extending through the elongate opening.

12. The connection device according to claim 10, wherein the anchor profile is a square profile.

13. The connection device according to claim 10, wherein the elongate opening extends throughout a full length of the anchor profile.

14. The connection device according to claim 1, further comprising a release tool having a plurality of segments configured to fit together such that they jointly form a sleeve around the central rod, said sleeve being movable along the central rod into the central recess and configured for forcing the at least one locking member radially outwards to its respective outer open position at said movement into the central recess.

15. The connection device according to claim 1, wherein the top anchor-includes a nut having a central threaded recess arranged for connection to a corresponding threaded portion of a central rod of a roof bolt.

16. A monorail system comprising:

a monorail beam; and a connection device according to claim 1.

17. The monorail system according to claim 16, wherein the clamping device is attached to the monorail beam.

* * * * *